United States Patent [19]

Shockey

[11] Patent Number: 4,987,622

[45] Date of Patent: Jan. 29, 1991

[54] SELF-OPERATED STAND UP SUPPORT APPARATUS

[76] Inventor: Winfred S. Shockey, 1342 E. 19th St., Winfield, Kans. 67156

[21] Appl. No.: 354,729

[22] Filed: May 22, 1989

[51] Int. Cl.[5] ..... A61G 7/00

[52] U.S. Cl. ..... 5/81 R; 5/61; 5/507

[58] Field of Search ..... 5/60, 61, 62, 81 R, 5/503, 507, 461

[56] References Cited

U.S. PATENT DOCUMENTS

| | | | |
|---|---|---|---|
| 920,500 | 5/1909 | Thomas | 5/62 |
| 992,671 | 5/1911 | Kester | 5/62 |
| 1,573,571 | 2/1926 | Pohl | 5/61 |
| 1,943,888 | 1/1934 | Ewald | 5/61 |
| 3,293,662 | 12/1966 | Ohrberg | 5/62 |
| 4,017,920 | 4/1977 | Sieg | 5/507 |
| 4,020,510 | 5/1977 | Fabian | 5/507 |
| 4,059,255 | 11/1977 | Perold | 5/62 |
| 4,282,614 | 8/1981 | Hurst | 5/507 |
| 4,465,255 | 8/1984 | Hill | 5/507 |
| 4,620,714 | 11/1986 | Davis | 5/62 |
| 4,672,697 | 6/1987 | Schurch | 5/62 |
| 4,685,159 | 8/1987 | Oetiker | 5/62 |
| 4,724,554 | 2/1988 | Kowalski et al. | 5/62 |

FOREIGN PATENT DOCUMENTS

| | | | |
|---|---|---|---|
| 1201097 | 12/1959 | France | 5/62 |
| 188943 | 11/1958 | Sweden | 5/62 |
| 359837 | 3/1962 | Switzerland | 5/61 |

*Primary Examiner*—Eric K. Nicholson
*Attorney, Agent, or Firm*—Phillip A. Rein

[57] ABSTRACT

This invention relates to a self-operating stand up support apparatus to be utilized by a person such as a quadriplegic for aid in movement from horizontal to vertical positions. The stand up support apparatus includes a main support frame assembly; a person support bed assembly pivotally connected to the main support frame assembly; and a power actuator and control assembly operable to selectively move the person support bed assembly. The main support frame assembly is provided with a support frame having a support wheel assembly connected thereto for ease of movement. The person support bed assembly is provided with a rectangular support frame supporting a body support assembly having a main body support and an upper body support. The upper body support is pivotal relative to the main body support to provide a work platform. The person support bed assembly further includes a person anchor assembly having a plurality of handle members and U-shaped anchor members to which anchor strap members are readily attached. The power actuator and control assembly includes a power actuator assembly connected to the person support bed assembly and a main control assembly. The power actuator assembly includes a motor member connected to a power screw member which, in turn, is connected to the body support assembly for pivotal movement thereof. The main control assembly includes a limit switch assembly and an actuator control assembly. The limit switch assembly includes horizontal and vertical control switches to limit movement of the person support bed assembly. The actuator control assembly includes an actuator member having raise and lower switch members to control movement of the stand up support apparatus.

5 Claims, 3 Drawing Sheets

SELF-OPERATED STAND UP SUPPORT APPARATUS

PRIOR ART

A patent search on this invention revealed the following United States Patents:

| Patent No. | Invention | Inventor |
|---|---|---|
| 2,887,691 | HOSPITAL BED | L. J. Talarico et al |
| 3,249,368 | AMBULATING DEVICE FOR PARAPLEGICS | Mejek Ginzburg |
| 3,640,520 | THERAPY TREATMENT TILT TABLE | Wieland et al |
| 3,997,926 | BED WITH AUTOMATIC TILTING OCCUPANT SUPPORT | Robert W. England |
| 4,099,277 | STANDER APPARATUS PROVIDING VARYING DEGREES OF WEIGHT BEARING FOR PATIENT THERAPY | Mervyn M. Watkins |
| 4,155,416 | OCCUPANT-OPERATED MOBILE WORK VEHICLE FOR PARAPLEGICS | Donald L. Ausmus |
| 4,390,076 | INTEGRATED WHEELCHAIR AND AMLBULATOR | Wier et al |
| 4,437,537 | VEHICLE FOR SUPPORTING HANDICAPPED OCCUPANTS | Donald L. Ausmus |
| 4,613,997 | VERTICAL ACCESS CONVALESCENT BED | Oscar E. Langdale |
| 4,776,605 | WHEELED BED APPARATUS | John E. Hathcock |

ANALYSIS

The Talarico et al patent discloses a hospital bed structure having elaborate powered linkage mechanisms for moving the support bed and person attached thereto from horizontal to vertical positions.

The Ginzburg, Watkins, and Hathcock patents disclose ambulatory devices being self-propelled for movement of a handicapped person.

The Wieland et al patent discloses a therapy treatment tilt table structure having a person movable from horizontal to vertical positions and held thereon by strap members.

The England patent discloses a tilting bed type structure including 1) a main frame structure mounted on wheel members; 2) a motor and screw mechanism to achieve tilting movement of the subject platform; 3) strap members to hold the person in place on moving to vertical positions; 4) a platform to receive the person's feet thereon to aid in vertical support; and 5) a control mechanism for movement thereof.

The Ausmus Pat. No. 4,155,416 and the Wier et al patent both disclose mobile work vehicles for paraplegics having features for placing the person in a vertical position.

The Ausmus Pat. No. 4,437,537 discloses a powered vehicle for handicapped occupants which can hold a person in a vertical condition.

The Langdale patent discloses a vertical access convalescent bed using a screw mechanism to move the attached person from horizontal to vertical conditions.

PREFERRED EMBODIMENT OF THE INVENTION

In one preferred embodiment of this invention, a self-operated stand up support apparatus is designed to be utilized by quadriplegics in order to receive a person thereon and move same from a horizontal position to an upright vertical position and may be operated by the person utilizing same. The self-operated stand up support apparatus includes 1) a main support frame assembly; 2) a person support bed assembly pivotally connected to the main support frame assembly; and 3) a power actuator and control assembly mounted on the main support frame assembly and operably connected to the person support bed assembly for moving same. The main support frame assembly includes 1) a support frame; 2) a panel cover assembly mounted about the support frame to enclose same; and 3) a support wheel assembly connected to the support frame so that the entire structure can be readily moved from one location to another. The support wheel assembly is provided with lock members so as to be anchored in a given position when so desired. The person support bed assembly includes 1) a rectangular support frame pivotally connected to the main support frame assembly; 2) a body support assembly connected to the rectangular support frame; and 3) a person anchor assembly connected to the body support assembly and the rectangular support frame. The body support assembly includes a main body support and an upper body support. The upper body support is pivotally connected to the main body support so as to provide an arm rest or work platform for the person utilizing same. The person anchor assembly includes 1) a plurality of handle members for grasping by the person utilizing same; 2) a plurality of U-shaped anchor members; and 3) anchor strap members respectively connected to the anchor members and adapted to be placed about the person using the stand up support apparatus to hold against the main body support. The power actuator and control assembly includes a power actuator assembly controlled through a main control assembly. The power actuator assembly includes a motor member secured to the main support frame assembly and connected to a power screw member which, in turn, is connected to the person support bed assembly in order to pivot same from a horizontal to a vertical position. The main control assembly is provided with a limit switch assembly and actuator control assembly. The limit switch assembly is provided with vertical and horizontal control switches in order to provide a safety feature in automatically de-enegizing the motor member on reaching the horizontal and the vertical positions of the person support bed assembly. The actuator control assembly includes an actuator member having controls thereon to energize the motor member for movement from the horizontal to the vertical position and can be easily accessed by the person utilizing the stand up support apparatus.

OBJECTS OF THE INVENTION

One object of this invention is to provide a stand up support apparatus which may be self-operated by the person utilizing same and operable to move a person connected thereto from horizontal to vertical positions and vice versa or any increments therebetween.

Another object of this invention is to provide a self-operated stand up support apparatus having a main support frame assembly, a person support bed assembly pivotally connected to the main support frame assembly, and a power actuator and control assembly which can be readily operated by the person utilizing same for pivotal movement of the person support bed assembly from horizontal to vertical positions.

One further object of this invention is to provide a self-operated stand up support apparatus including a person support bed assembly pivotally connected to a main support frame assembly and having an upper body support which is pivotally and independently movable to an inclined position to provide a forearm support area for the person utilizing same.

One other object of this invention is to provide a self-operated stand up support apparatus including a main support frame assembly with a person support bed assembly pivotally connected thereto and having control limit switches to provide a safety feature to stop movement of the person support bed assembly at the horizontal and vertical positions.

One further object of this invention is to provide a self-operated stand up support apparatus having a person support bed assembly to which the person placed thereon can be strapped against for safety reasons and being operable through a power actuator and control assembly by the person utilizing same for movement from horizontal to vertical postions and any increment position therebetween.

Still, one other object of this invention is to provide a self-operated stand up support apparatus including a person support bed assembly; a power actuator and control assembly for operation by the person utilizing same for movement from horizontal to vertical positions; and an upper body support pivotally movable to an inclined position for support of the person's forearms thereon which can be used as a work area to support writing materials and the like.

Various other objects, advantages, and features of the invention will become apparent to those skilled in the art from the following discussion, taken in conjunction with the accompanying drawings, in which:

FIGURES OF THE INVENTION

Figure 1:
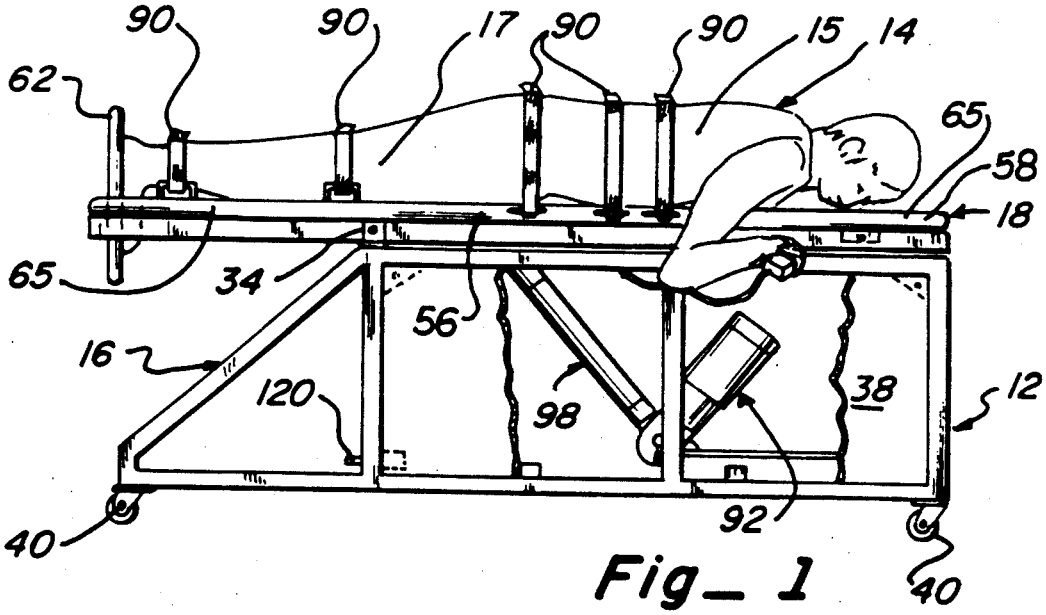
FIG. 1 is a side elevational view of a self-operated stand up support apparatus of this invention illustrated with a person mounted thereon in a horizontal position.

The following is a discussion and description of preferred specific embodiments of the self-operated stand up support apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a stand up support apparatus of this invention, indicated generally at 12, is illustrated as having a person 14 connected thereto in a horizontal, face down position. The stand up support apparatus was designed to be self-operated by electrical controls for use by a quadriplegic or similar person as will be described. A quadriplegic is a person afflicted with paralysis of both arms and both legs and the necessity of this invention is the need to move the quadriplegic from a horizontal to a vertical position to aid in blood circulation; other medical reasons; transporting to desired locations; and general pleasure of the quadriplegic. The person 14 has an upper body section 15 and a lower body section 17 which may be connected to the stand up support apparatus 12 in a manner to be described.

Figure 3:
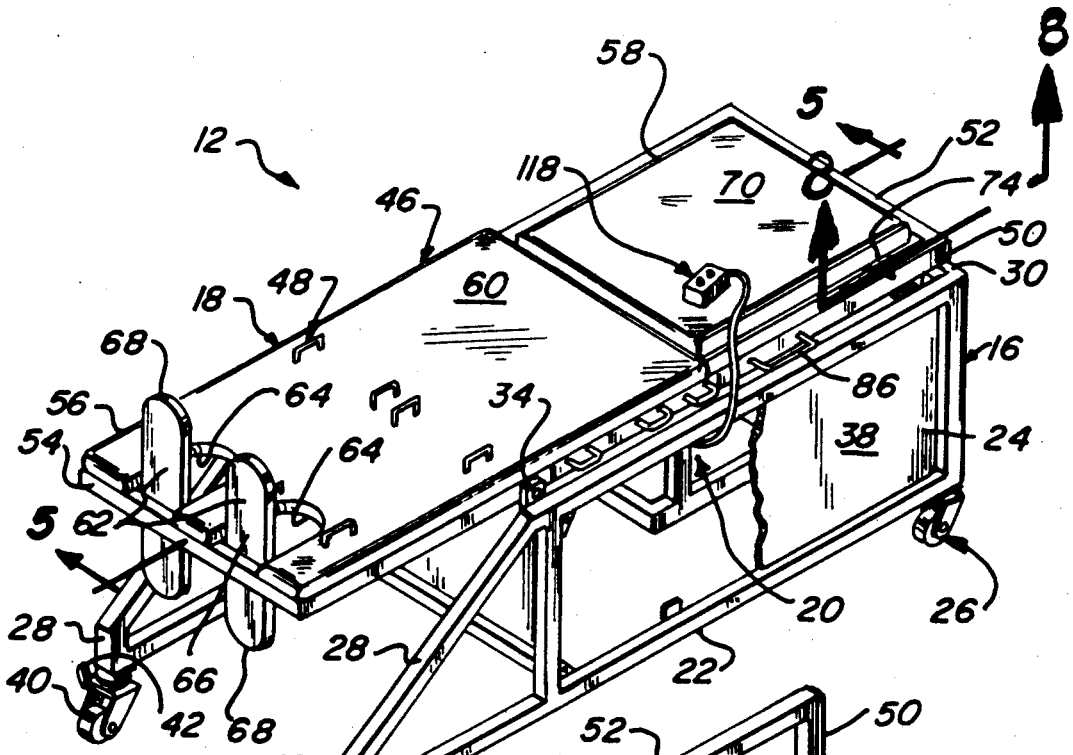
FIG. 3 is a perspective view of the self-operated stand up support apparatus of this invention.

As noted in FIG. 3, the stand up support apparatus 12 includes (1) a main support frame assembly 16; (2) a person support bed assembly 18 pivotally connected to the main support frame assembly 16; and (3) a power actuator and control assembly 20 which is mounted on the main support frame assembly 16 and operably connected to the person support bed assembly 18. The main support frame assembly 16 includes (1) a support frame 22; (2) a panel cover assembly 24 connected to the support frame 22; and (3) a support wheel assembly 26 connected to the support frame 22.

The support frame 22 is provided with (1) a pair of side support assemblies 28 connected at a forward end by parallel, spaced front support members 30; (2) spaced, horizontal upper support plates 32 interconnected between an upper one of the front support members 30 and the side support assemblies 28; and (3) a pair of spaced upright connector lug members 34 connected to an upper surface of the side support assemblies 28 to provide support and pivotal movement of the person support bed assembly 18 as will be described.

The support frame 22 is covered by the panel cover assembly 24 which includes a front panel member 36 connected between the front support member 30 and parallel side panel members 38 connected to respective ones of the side support assemblies 28.

The support wheel assembly 26 includes a plurality, namely four, caster members 40 attached to each respective lower corner of the support frame 22. The caster members 40 are each provided with a lock member 42 so that the caster members 40 are lockable so that the wheel portions are non-rotatable and the entire stand up support apparatus will not move when the lock members 42 are utilized.

The person support bed assembly 18 includes (1) a rectangular support frame 44; (2) a body support assembly 46 mounted on the rectangular support frame 44; and (3) a person anchor assembly 48 connected to the body support assembly 46 and the rectangular support frame 44 for reasons to be explained.

The rectangular support frame 44 is constructed of square tubular material having opposed parallel side tube members 50; a front tube member 52 interconnecting the forward ends of the side tube members 50; and a rear tube member 54 interconnecting the adjacent rear end portions of the side tube members 50. The side tube members 50 are provided with opposed pivot shafts 55 mounted within the connector lug members 34 of the support frame 22 to achieve pivotal movement of the body support assembly 46.

The body support assembly 46 includes a main body support 56 mounted on an upper surface of the rectangular support frame 44 and an upper body support 58 pivotally connected to the main body support 56.

The main body support 56 includes a support member 60 of a generally rectangular shape and a pair of foot support members 62. The support member 60 is provided with foot cutout sections 64 and, on the interior thereof, a padding material 65 which can be enclosed with an upholstery material such as leather, plastic, or the like. The foot cutout sections 64 are of a size to allow a person's feet with shoes thereon to be extended therethrough.

The foot support members 62 are of a generally oval shape, each having a main body section 66 integral with curved end sections 68. The foot support members 62 are secured as by bolts, welding, or the like to the rear tube member 54 of the rectangular support frame 44.

Figure 4:
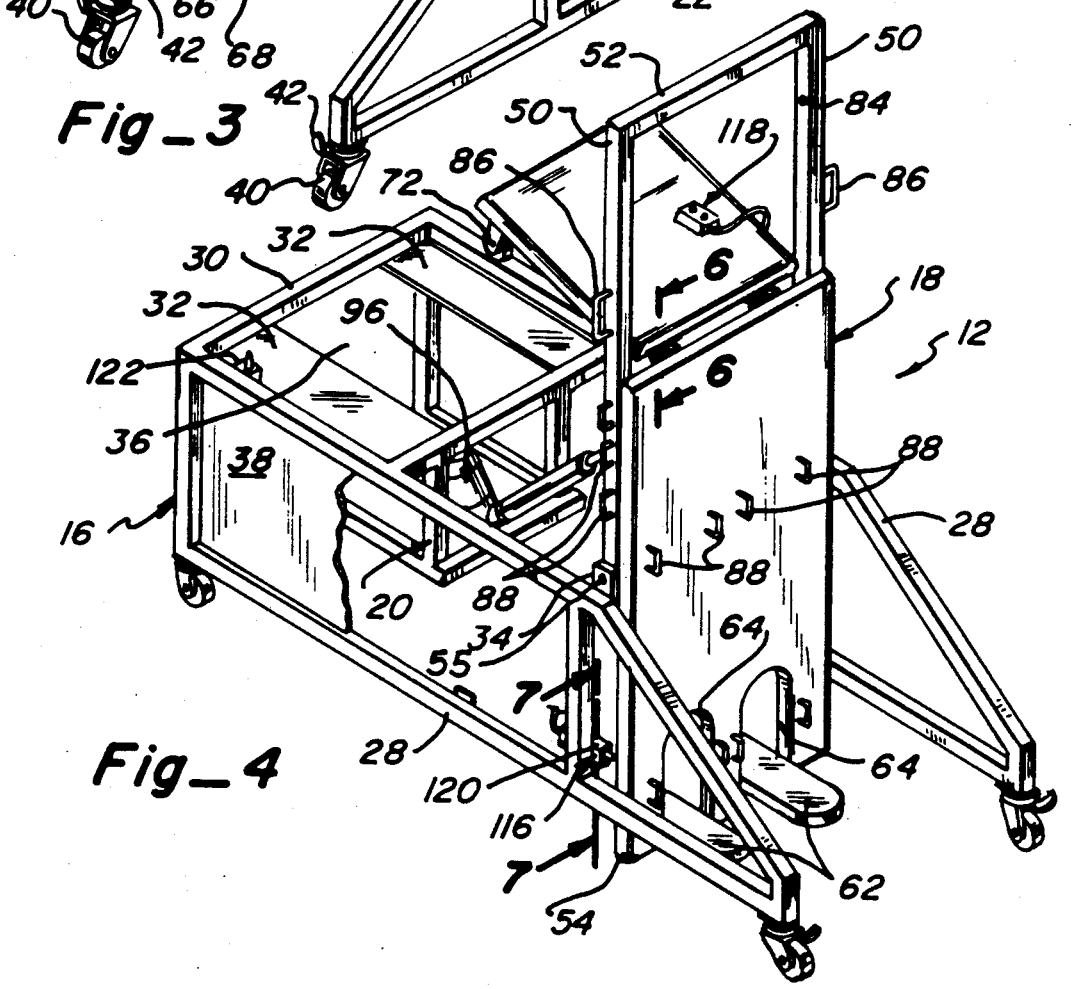
FIG. 4 is a perspective view of the self-operated stand up support apparatus of this invention with the upper body support in an inclined position and a main body support illustrated in a vertical position.
Figure 5:
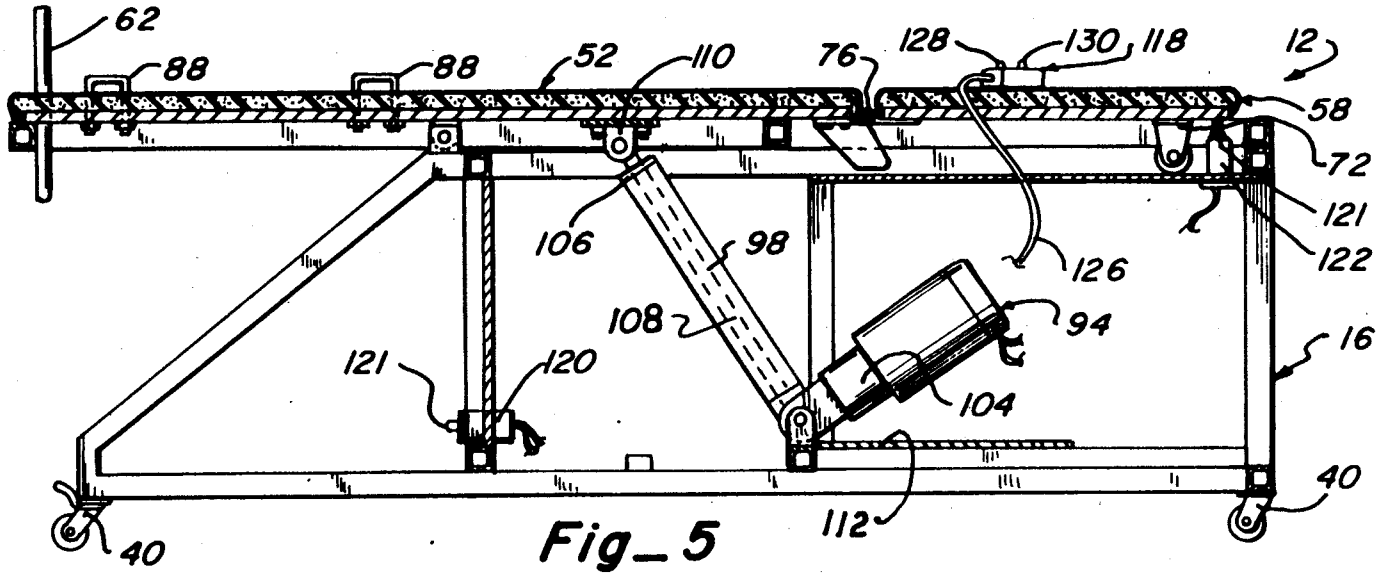
FIG. 5 is an enlarged sectional view taken along line 5—5 in FIG. 3.
Figure 8:
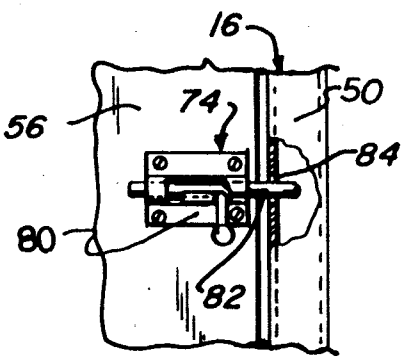
FIG. 8 is an enlarged fragmentary sectional view taken along line 8—8 in FIG. 3.
Figure 7:
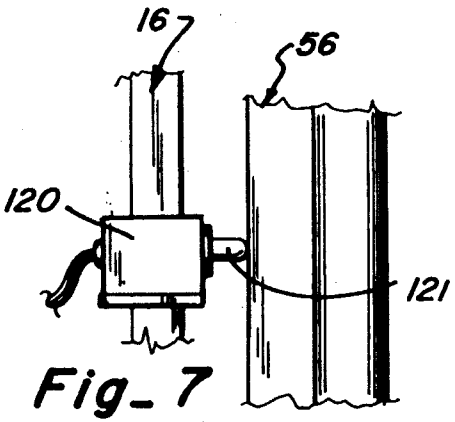
FIG. 7 is an enlarged fragmentary sectional view taken along line 7—7 in FIG. 4.

The upper body support 58 includes (1) an upper support member 70; (2) a pair of roller members 72 secured to a forward undersurface of the upper support member 70; (3) an anchor hinge member 74 for locking purposes to the support frame 44; and (4) pivotal hinge members 76 connected between one edge of the upper support member 70 and to the adjacent portion of the main body support 56 for pivotal movement as noted in FIGS. 2 and 4.

The upper support member 70 is of a generally square shape having an inner padding material 65 enclosed with an upholstery material such as leather, plastic, or the like.

The roller members 72 are operable in a manner to contact and roll on the upper support plates 32 of the main support frame assembly 16 on movement from horizontal to vertical positions as will be explained.

The anchor hinge member 74 is of a known type having a support hinge 80, a slide bolt member 82, and a connector hole 84 in an adjacent portion of the side tube members 50 of the support frame 44. The anchor hinge member 74 is operable to lock the upper support member 70 in a position parallel to the main body support 56 as noted in FIG. 3.

Figure 6:
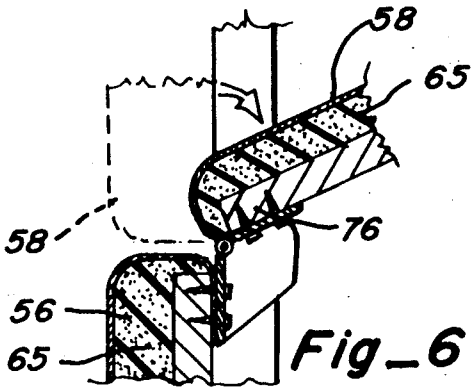
FIG. 6 is an enlarged fragmentary sectional view taken along line 6—6 in FIG. 4.

The pair of spaced hinge members 76 are operable to allow pivotal movement of the upper support member 70 relative to the main body support 56 as noted in FIG. 6.

The person anchor assembly 48 includes (1) a pair of handle members 86 secured to and extended laterally from opposite ones of the side tube members 50 of the rectangular support frame 44; (2) a plurality of U-shaped anchor members 88, some secured to and extended upwardly from an upper surface of the main body support 56 and others secured to the side tube members 50; and (3) a plurality of anchor strap members 90 which are releasably mounted about the person 14 as noted in FIGS. 1 and 2. The anchor strap members 90 are each provided with a main strap member and a releasably buckle member operable in a conventional manner. The anchor strap members 90 are respectively connectable to the U-shaped anchor members 88 which are attached to an upper surface of the main body support 56 and to a side surface of the side tube members 50 of the rectangular support frame 44. This provides numerous rigid support members placed about the person utilizing the self-operated stand up support apparatus 12 for holding against the body support assembly 46 in the upright condition as noted in FIG. 2.

The power actuator and control assembly 20 includes a power actuator assembly 92 operably connected to a main control assembly 94. The power actuator assembly 92 includes an electric motor member 96 connected to a power screw member 98. The motor member 96 is connected to a power cord 102 to provide electricity to a drive member 104. The drive member 104 is a gear reducer to regulate rotation of the power screw member 98 to move the person support bed assembly 18 from the horizontal to the vertical position and vice versa as will be described.

The power screw member 98 includes a piston rod 106 mounted within a control cylinder 108. The piston rod 106 is pivotally connected by a connector plate 110 to an undersurface of the main body support 56 of the person support bed assembly 18. The control cylinder 108 is pivotally connected to an anchor plate 112 which, in turn, is secured to the rectangular support frame 44.

The main control assembly 94 includes a limit switch assembly 116 connected to an actuator control assembly 118. The limit switch assembly 116 includes a vertical control switch 120 and a horizontal control switch 122. Both of the control switches 120 and 122 are provided with a plunger member 121 which is movable inwardly to a depressed condition to de-energize current to the motor member 96 of the power actuator assembly 92. This actuation of the limit switch assembly 116 assures that pivotal movement of the entire person support bed assembly 18 will be stopped on reaching the horizontal and vertical positions. This is a safety feature in case of any failure of controls or error of the person utilizing the stand up support apparatus 12 to deenergize the motor member 96 at the right time.

The actuator control assembly 118 includes an actuator member 124 connected through a power supply cord 126 to the motor member 96. The actuator member 124 is provided with a raise switch member 128 and a lower switch member 130. The switch members 128, 130 are operable to stop, start, and control rotation of the motor member 96 to raise and lower the person support bed assembly 18 such as from the horizontal position in FIG. 1 to the vertical position in FIG. 2.

USE AND OPERATION OF THE INVENTION

In the use and operation of the invention, we will assume that the stand up support apparatus 12 is in the condition as noted in FIG. 3. When the stand up support apparatus 12 is utilized in the case of a quadriplegic, the normal procedure is to move an abutting side of the main support frame assembly 16 adjacent to a person's 14 bed or the like. Then, the person 14 can be moved onto the body support assembly 46 and placed with the person's 14 face projected downwardly as noted in FIG. 1. The person's 14 foot members, with or without shoes thereon, can be placed through the foot cutout section 64 in the main body support 56. When in this position, it is noted that a plurality of the anchor strap members 90 can then be placed about respective portions of the person's 14 ankle, leg, thigh, and lower back areas as noted in FIG. 1. The buckle members can then secure the anchor strap members 90 to provide firm attachment of the person 14 against the main body support 56.

At this time, it is noted that the power actuator and control assembly 20 is energized through a power supply cord which is inserted in a power outlet receptacle to provide power such as 110 volt A.C. current thereto.

In the condition shown in FIG. 1, the person 14, if having movement of finger members and partial movement of an arm, can then use the main control assembly 94 and, more specifically, the actuator member 124 in order to press the raise switch member 128. As long as the raise switch member 128 is depressed, the person support bed assembly 18 will pivot about the connector lugs 34 as noted by arrow 134 in FIG. 2 for pivoting to the vertical position or any inclined position therebetween.

On reaching the vertical position, the person 14 can release the raise switch member 128 which will stop energization of the motor member 96 and rotation of the power screw member 98 to cease movement in the direction of the arrow 134.

Figure 2:
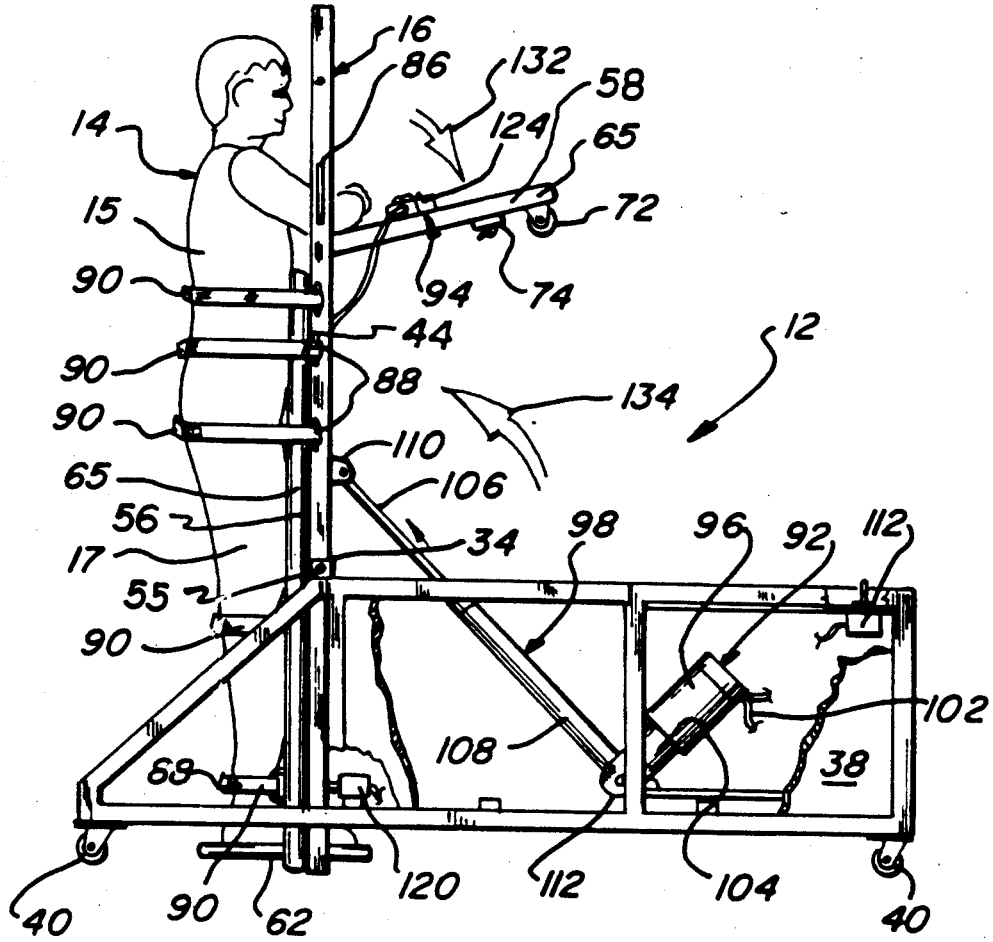
FIG. 2 is a side elevational view similar to FIG. 1 illustrating the self-operated stand up support apparatus with the person mounted thereon moved to the vertical position and having an upper body support extended in an inclined position.

In case the person 14 is unable or forgets to release the raise switch member 128, the vertical control switch 120 has the plunger member 121 depressed by the abutting part of the rectangular support frame 44 as noted in FIG. 2 which will deenergize the motor member 96.

Next, the upper body support 58 can be released from its connection by the slide bolt member 82 of the anchor hinge member 74 to the adjacent side tube member 50 of the rectangular support frame 44. This allows the upper body support 58 to pivot downwardly as noted by arrow 132 in FIG. 2 to an inclined position such as 30 degrees from a horizontal plane. This provides for a forearm resting portion for the person 14 and a working platform to hold reading materials and the like.

In the position of FIG. 2, it is seen that the person 14 is held securely in an upright position with the foot members of the person 14 resting comfortably on the foot support members 62. Also, the pivotal movement of the upper body support 58 allows for the person 14 to be comfortable and see through this area for viewing television or the like. Additionally, the placing of the person 14 in the upright vertical condition in the case of a quadriplegic allows for improved blood circulation throughout the body and, more specifically, into the ankle areas to reduce swelling and incurring other medical problems.

When the person 14 wishes to cease use of the stand up support apparatus 12 when in the condition of FIG. 2, the person 14 or an assistant would operate the lower switch member 130 of the actuator control assembly 118. This would then energize and reverse rotation of the motor member 96 which would drive the power screw member 98 in a direction opposite that for raising same and return the person support bed assembly 18 to the horizontal position of FIG. 1.

It is noted that the upper body support 58, if left in an inclined position on movement to the horizontal position, the roller members 72 would contact the upper support plates 32 and pivot the upper body support 58 to the horizontal position as noted in FIG. 1.

In the alternative, the person 14 or an assistant could first return the upper body support 58 to a vertical position and lock in this position through use of the anchor hinge member 74 and, more specifically, movement of the slide bolt member 82 into the connector hole 84 in the side tube member 50.

On reaching the horizontal condition of FIG. 1, the downward movement is ceased by either release of the lower switch member 130 or engagement of the horizontal control switch 122 and, more specifically, the plunger member 121 against the rectangular support frame 44 would de-energize the motor member 96.

On reaching the condition of FIG. 1, it is obvious that the entire stand up support apparatus 12 can be moved to the desired position such as adjacent the bed of the person 14 with the person 14 transferred to the bed after release of the anchor strap members 90 in a conventional manner.

The electrical connectors of the power actuator and control assembly 20 are well known with electrical power supplied to the actuator member 124 and in series with the control switches 120, 122 before being supplied to the motor member 96. Therefore, the opening of either of the control switches 120, 122 will deenergize the motor member 96.

The stand up support apparatus is sturdy in construction; includes many connector features for anchoring a person thereto; designed with safety features so as to be non-tiltable to prevent injury to the person utilizing same; easy in operation; relatively inexpensive to manufacture; and substantially maintenance free.

While the invention has been described in conjunction with preferred specific embodiments thereof, it will be understood that this description is intended to illustrate and not to limit the scope of the invention, which is defined by the following claims:

I claim:

1. A stand up support apparatus operable to receive and secure a person thereagainst for subsequent movement from a horizontal to a vertical position and vise versa, comprising:

(a) a main support frame assembly;

(b) a person support bed assembly including a body support assembly mounted on a support frame and pivotally connected to said main support frame assembly;

(c) said body support assembly includes a main body support connected to said support frame and an upper body support pivotally connected to said main body support and in one position having a support surface extending in the same plane as said support surface of said upper body support;

(d) said upper body support pivotal downwardly to a second position between an upper portion of said support frame at an angle of inclination relative to said main body support to form a work platform and an open area; and (e) said upper body support includes an upper support member, hinge members to pivotally connect said upper support member to said main body support, and an anchor hinge member to secure said upper support member to said upper portion of said support frame in the same plane common to said main body support;

whereby the person using said stand up support apparatus can observe television and the like through said support frame.

2. A stand up support apparatus as described in claim 1, wherein:

(a) said angle of inclination of said upper body support relative to a plane perpendicular to said main body support being 25–35 degrees and forming a continuous angular support area with said upper body support and said main body support; and (b) said anchor hinge member secured to said upper portion of said upper support member having a slide bolt member engagable with said support frame in a locked condition.

3. A stand up support apparatus operable to receive and secure a person thereagainst for subsequent movement from a horizontal to a vertical position and vice versa, comprising:

(a) said main support frame assembly;

(b) a person support bed assembly including a body support assembly pivotally connected to said main support frame assembly and movable from horizontal to vertical positions;

(c) a power actuator and control assembly connected between said main support frame assembly and said person support bed assembly operable to pivot said person support bed assembly from horizontal to vertical positions;

(d) said power actuator and control assembly includes a main control assembly having a limit switch assembly secured to said main support frame assembly and engagable with said person support bed assembly to automatically stop movement thereof on reaching the horizontal and vertical positions;

(e) said body support assembly having a main body support and an upper body support;

(f) said upper body support includes an upper support member pivotally connected to said main body support and being pivotally movable to an angular position as a platform for use by the person utilizing said stand up support apparatus; and (g) said main support frame assembly having support plates engagable with said upper body support when in the same plane with said main body support; and (h) said upper body support includes roller members secured to an underside of said upper support member and engagable with said support plates on movement of said person support bed assembly from the vertical to the horizontal position.

4. A stand up support apparatus operable to receive and secure a person thereagainst for subsequent movement from a horizontal to a vertical position and vice versa, comprising:

(a) a main support frame assembly;

(b) a person support bed assembly including a body support assembly mounted on a support frame and pivotally connected to said main support frame assembly;

(c) said body support assembly includes a main body support connected to said support frame and an upper body support pivotally connected to said main body support and in one position having a support surface extending in the same plane as said support surface of said upper body support;

(d) said upper body support pivotal downwardly to a second position between an upper portion of said support frame at an angle of inclination relative to said main body support to form a work platform and an open area;

(e) said upper body support includes an upper support member pivotally connected by a support hinge to said main body support and roller members secured to a forward undersurface of said upper support member; and (f) said main support frame assembly includes support plates engagable with said roller members on said upper support member when in the same plane with said main body support.

whereby the person using the stand up support apparatus can observe television and the like through said support frame.

5. A stand up support apparatus as described in claim 4, wherein:

(a) said upper body support includes an anchor hinge member mounted on an upper outer portion of said upper support member to releasably secure same to an adjacent portion of said support frame.

* * * * *